US006948926B2

(12) United States Patent
Valentine et al.

(10) Patent No.: US 6,948,926 B2
(45) Date of Patent: Sep. 27, 2005

(54) REDUCED-EMISSIONS COMBUSTION UTILIZING MULTIPLE-COMPONENT METALLIC COMBUSTION CATALYST

(75) Inventors: James M. Valentine, Fairfield, CT (US); Barry N. Sprague, Bethlehem, CT (US)

(73) Assignee: Clean Diesel Technologies, Inc., Stamford, CT (US)

( * ) Notice: Subject to any disclaimer, the term of this patent is extended or adjusted under 35 U.S.C. 154(b) by 0 days.

(21) Appl. No.: 10/306,954

(22) Filed: Nov. 29, 2002

(65) Prior Publication Data

US 2003/0148235 A1 Aug. 7, 2003

Related U.S. Application Data

(60) Provisional application No. 60/354,435, filed on Feb. 4, 2002.

(51) Int. Cl.[7] ..... F23J 7/00

(52) U.S. Cl. ..... 431/2; 431/3; 431/4; 44/321; 123/1 A

(58) Field of Search ..... 431/2, 3, 4; 44/321, 44/905; 123/1 A

(56) References Cited

U.S. PATENT DOCUMENTS 4,629,472 A * 12/1986 Haney et al. ..... 44/301
4,892,562 A * 1/1990 Bowers et al. ..... 44/324
5,034,020 A * 7/1991 Epperly et al. ..... 44/358
5,501,714 A * 3/1996 Valentine et al. ..... 44/358
5,535,708 A * 7/1996 Valentine ..... 123/25 C
5,584,894 A * 12/1996 Peter-Hoblyn et al. ..... 44/301
5,693,106 A * 12/1997 Peter-Hoblyn et al. ..... 44/301
5,743,922 A * 4/1998 Peter-Hoblyn et al. ..... 44/301
6,039,261 A * 3/2000 Pavese ..... 236/14
6,051,040 A * 4/2000 Peter-Hoblyn ..... 44/358
6,419,477 B1 * 7/2002 Robinson ..... 431/4

* cited by examiner

*Primary Examiner*—Alfred Basichas
(74) *Attorney, Agent, or Firm*—Thaddius J. Carvis

(57) ABSTRACT

Residual fuels, as well as lighter distillate fuels, are combusted with greater efficiency by utilizing low concentrations of specific bimetallic or trimetallic fuel-borne catalysts. The catalysts reduce fouling of heat transfer surfaces by unburned carbon while limiting the amount of secondary additive ash which may itself cause overloading of particulate collector devices or emissions of toxic ultra fine particles when used in forms and quantities typically employed. By utilizing a fuel containing a fuel-soluble catalyst comprised of platinum and at least one additional metal comprising cerium and/or iron, production of pollutants of the type generated by incomplete combustion is reduced. Ultra low levels of nontoxic metal combustion catalysts are able to be employed for improved heat recovery and lower emissions of regulated pollutants.

8 Claims, 2 Drawing Sheets

REDUCED-EMISSIONS COMBUSTION UTILIZING MULTIPLE-COMPONENT METALLIC COMBUSTION CATALYST

This application claims the benefit of Provisional Application No. 60/354,435, filed Feb. 4, 2002.

BACKGROUND OF THE INVENTION

The invention concerns new compositions and a new process for improving the efficiency of fossil fuel combustion sources, especially lean-$NO_x$ combustors, by reducing the fouling of heat transfer surfaces by unburned carbon while limiting the amount of secondary additive ash. Utilizing a fuel containing a fuel-soluble catalyst comprised of platinum and at least one additional metal also reduces production of pollutants of the type generated by incomplete combustion, e.g., particulates, unburned hydrocarbons and carbon monoxide.

Efforts to improve power generation efficiency have often lead to the use of heat recovery steam generators to obtain additional flue gas heat recovery. This has the advantage of improving cycle efficiency, but unburned carbon can form deposits and reduce heat transfer in these devices. Moreover, the use of combustion catalysts can lead to the production of ash, which can itself reduce heat transfer efficiency unless regular maintenance routines are followed—often resulting in shutting down the process for cleaning.

In some efforts to reduce pollution from diesel engines, natural gas is being employed as an alternative fuel. Unfortunately, difficulties have arisen in obtaining good combustion by compression alone and the natural gas does not readily ignite as it is compressed. In some cases, an ignition source is provided to ignite the natural gas. The ignition source may be provided by a spark plug similar to those used in spark ignition engines. Alternatively, dual-fuel diesel engines can facilitate ignition by injecting a small amount of diesel or other pilot fuel into a mixture of air and gaseous fuel prior to or during compression. In some engines of this type, the generation of soot can be troublesome.

The use of downstream particulate removal systems has gained wide acceptance, but these devices add costs in terms of initial investment and periodic maintenance. It would be desirable to enable combustion under conditions which favored less carbon generation without the need for levels of combustion catalysts that are too expensive or result in ash that would burden particulate removal systems or cause fouling that requires cleaning to maintain efficiency. Moreover, it would be desirable to provide effective and efficient combustion and reduced stack gas opacity without excessive generation of high levels of fine metallic particulates which might escape to the atmosphere.

Some fuel borne catalysts have been identified as health risks and cannot be employed at any level. It would be desirable to utilize nontoxic metal combustion catalysts at low and ultra low levels to achieve improved heat recovery and lower emissions of regulated pollutants.

There is a need for a new low-emissions combustion process to reduce emissions of one or more regulated pollutants which can also be used to reduce carbon or particulates from the combustion gases that may cause smoky emissions or fouling of heat transfer surfaces or downstream heat recovery devices.

SUMMARY OF THE INVENTION

The invention provides a new process addressing the above needs of combustors such as turbines, boilers, furnaces, process heaters, heat recovery units, diesel engines, and the like, utilizing carbonaceous, e.g., fossil fuels such as distillates, residual and gaseous fuels. It is an advantage of the invention that improvements can be achieved without the use of after treatment devices, such as filters or catalysts, e.g., diesel particulate filters (DPF's) or diesel oxidation catalysts (DOC's) in the case of diesel engines.

The fuel employed according to the invention comprises carbonaceous fuel, e.g., fossil fuel, containing low or ultra low levels of catalyst metal additives. The catalyst metal additives will preferably be soluble or dispersible in the fuel and contain platinum and cerium and/or iron compositions, but in some cases can be added in whole or in part to the combustion air.

In one aspect, the process will comprise: mixing with fuel or combustion air a multi-component combustion catalyst comprising a platinum composition and cerium and/or iron compositions at levels reduced to as low as 0.0005 ppm for platinum and levels as low as 0.5 ppm for the cerium and iron; and combusting fuel with air in the presence of the catalyst in a regimen of treatment that will utilize effective catalyst levels for a time and under conditions, which will achieve one or more of the noted improvements. In one aspect, low catalyst levels can be employed for at least a portion of a treatment regimen, which can also include employing a higher initial dose and/or intermittently using higher catalyst levels. The ratio of cerium and/or iron to platinum will be within the range of from 3:1 to 100,000:1, but more typically will be in the range of from 100:1 to 20,000:1. Cerium is a preferred catalyst metal when the fuel is No. 2 fuel oil, and a combination of cerium and iron are preferred when the fuel is a residual oil, such as No. 6 oil.

The invention has particular advantage in improving combustion in processes such as the burning of fuels which are notoriously dirty in terms of soot generation, typically heavy fuels, e.g., residual fuels like No. 4, 5 and 6 oils. These oils are characterized by high viscosities, being just barely pourable or unpourable at 70° F., contain high levels of condensed aromatics and tend to be difficult to combust fully and cleanly. In this case, the multi-component catalyst can be employed as a combustion aid to reduce soot formation initially and/or to aid auto combustion of soot in the ductwork downstream of the combustor. Typical of low catalyst levels for at least a part of a treatment regimen are platinum concentrations of from only 0.0005 to less than 0.15, e.g., less than 0.1, ppm and cerium and/or iron at total concentrations of from only 0.5 to less than 20, e.g., less than about 15, ppm. In some embodiments, the treatment regimen can call for the utilizing higher catalyst concentrations initially or at defined intervals or as needed—but not for the whole treatment as has been necessary in the past. In some cases, platinum concentrations can be as high as 1 ppm or even up to 2 ppm, as needed.

The invention has similar advantage in the case of burning lighter fuels, such as those categorized as fuel oils, such as No. 2 fuel oil, which can result in lesser, but significant production of carbonaceous soot. Typical of low catalyst levels for at least a part of a treatment regimen are platinum concentrations of from only 0.0005 to less than 0.15, e.g., less than 0.1, ppm and cerium and/or iron at total concentrations of from only 0.05 to less than 8 ppm. Again, in some embodiments, the treatment regimen can call for the utilizing higher catalyst concentrations initially or at defined intervals or as needed. For No. 2 fuel oil, a bimetallic FBC containing platinum and cerium is preferred.

The invention also has significant beneficial use in the area of dual-fuel diesel engines, which although they operate principally on natural gas, utilize a more smoke-producing pilot fuel such as regular diesel fuel. In some cases the catalyst concentrations according to the invention can be the above-noted low catalyst levels for at least a part of a treatment regimen, with platinum concentrations of from only 0.0005 to less than 0.15 ppm, e.g., less than 0.1 ppm, say 0.01 to 0.09 ppm, and cerium and/or iron at total concentrations of from only 0.5 to less than 8 ppm. In some cases, it will be useful to utilize less than 0.05 ppm platinum and a total catalyst level of less than 5 ppm.

Many of the preferred aspects of the invention are described below. Equivalent compositions are contemplated.

DESCRIPTION OF THE DRAWINGS

The invention will be better understood and its advantages will become more apparent from the following written description, especially when read in light of the accompanying drawings wherein.

DESCRIPTION OF THE INVENTION

Figure 1A:
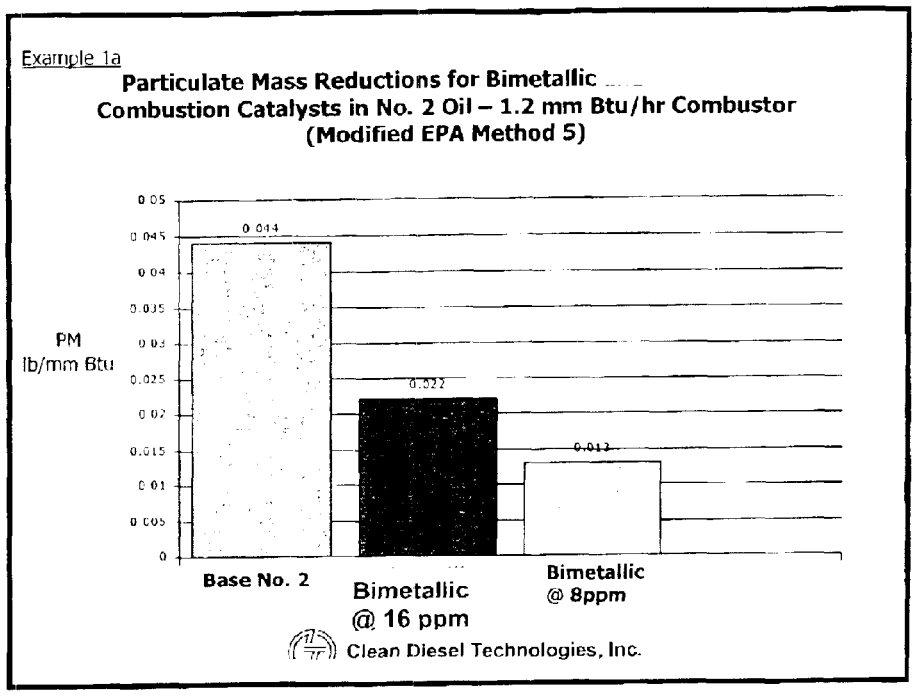
FIG. 1*a* is a graph summarizing the effect of bimetallic and trimetallic FBC's on particulate emissions with No. 2 fuel oil.

As noted above, the invention relates to improving combustion of various carbonaceous fuels, which typically comprise a fossil fuel, such as any of the typical petroleum-derived fuels including distillate fuels, residual fuels alone or in combination with gaseous fuels. The improvement for each type of fuel is important when viewed from the perspective of soot generation, soot auto-combustion, particulate recovery and/or the need to clean either the combustor or downstream equipment intended either for heat recovery or solids removal.

As required by a particular process or combustor, a fuel can be one or a blend of fuels selected from the group consisting of distillate fuels, including diesel fuel, e.g., No. 2 Diesel fuel, gasoline, jet fuel, e.g., Jet A, or the like, and biologically-derived fuels, such as those comprising a "mono-alkyl ester-based oxygenated fuel", i.e., fatty acid esters, preferably methyl esters of fatty acids derived from triglycerides, e.g., soybean oil, Canola oil and/or tallow. Other hydrocarbons, including liquids and gases, e.g., natural gas, or fuels derived from gas and/or emulsion components can be employed.

As noted above, the invention has particular advantage in improving combustion in processes such as the burning of fuels which are notoriously dirty in terms of soot generation, typically heavy fuels, e.g., residual fuels like No. 4, 5 and 6 oils. No. 6 oil has a minimum viscosity of 45 SSF at 122° F. (50° C.). No. 5 oil has a minimum viscosity of 150 SSU at 100° F. and a maximum viscosity of 40 SSF at 122° F. No. 4 oil has a minimum viscosity of 45 SSU at 100° F. and a maximum viscosity of 125 SSU at 100° F. These oils are characterized by high viscosities, being just barely pourable or unpourable at 70° F., contain high levels of condensed aromatics and tend to be difficult to combust fully and cleanly. No. 2 fuel oil is lighter and has a maximum viscosity of 40 SSU at 100° F.

In addition to the other advantages and improvements of the invention, the use of low and ultra-low individual and combined catalyst levels is significant in several regards, including the great reduction in catalyst solids which can accumulate within a system or are exhausted. The invention can reduce pollutants without the use of after-treatment devices and can enhance after treatment due to the reduced production of particulates and the increased ability to burn off carbon deposits. Cerium and iron levels are reduced to levels as low as 0.05 ppm and platinum levels are reduced to levels as low as 0.0005 ppm. A regimen of treatment will utilize effective levels within the low and ultra-low ranges for a time and under conditions, which will achieve one or more of the noted improvements.

The process of the invention employs a fuel-soluble, multi-metal catalyst, preferably comprising fuel-soluble platinum and either cerium or iron or both cerium and iron. The cerium and/or iron are typically employed at concentrations of from 0.5 to 20 ppm and the platinum from 0.0005 to 2 ppm, with preferred levels of cerium or iron being from 5 to 10 ppm, e.g., 7.5 ppm, and the platinum being employed at a level of from 0.0005 to 0.5 ppm, e.g., less than 0.15 ppm, and in some cases less than 0.1 ppm, say 0.01 to 0.09 ppm. In some embodiments, the treatment regimen can call for the utilizing higher catalyst concentrations initially or at defined intervals or as needed—but not for the whole treatment as has been necessary in the past. In some cases, platinum concentrations can be as high as 1 ppm or even up to 2 ppm, as needed.

A preferred ratio of cerium and/or iron to platinum is from 100,000:1 to 3:1, e.g., in the range of from 100:1 to 20,000:1, but more typically will be from 50,000:1 to 500:1. A formulation using 0.0015 ppm platinum with 10 ppm of cerium and 5 ppm of iron is exemplary, with a ratio of cerium plus iron to platinum of about 10,000:1 to 1,000:1. An alternative exemplary composition will contain 0.0015 ppm platinum with 10 ppm of iron and 5 ppm of cerium.

The fuel component of the blend can contain detergent (e.g., 50–300 ppm), lubricity additive (e.g., 25 to about 500 ppm), other additives, and suitable fuel-soluble catalyst metal compositions, e.g., 0.1–2 ppm fuel soluble platinum group metal composition, e.g., platinum COD or platinum acetylacetonate and/or 2–20 ppm fuel soluble cerium or iron composition, e.g., cerium, cerium octoate, ferrocene, iron oleate, iron octoate and the like. The fuel as defined, is combusted without the specific need for other treatment devices although they can be used especially for higher levels of control on diesels.

A combination of platinum with iron and/or cerium at low concentrations in fuels is as effective as much higher concentrations of cerium, iron or other metals without platinum in reducing carbon or soot deposits or emissions. Concentrations of a few ppm metals in combination are as effective as 30–100 ppm of iron and/or cerium used alone. These traditional levels of cerium or iron are high enough to be factors in causing fouling of heat transfer surfaces due to the high ash burden associated with high metal concentrations in the fuel. High levels of iron can also lead to increased conversion of $SO_2$ to $SO_3$ in flue gas which can increase back end corrosion and stack gas opacity. The invention enables achieving the benefits of higher levels of iron without the adverse effects.

In one aspect, the process of the invention will comprise: mixing with fuel or combustion air a multi-component combustion catalyst comprising a platinum composition and cerium and/or iron compositions at levels reduced to as low as 0.0005 ppm for platinum and levels as low as 0.5 ppm for the cerium and iron; and combusting fuel with air in the presence of the catalyst in a regimen of treatment that will utilize effective catalyst levels for a time and under conditions, which will achieve one or more of the noted improvements. In one aspect, low catalyst levels can be employed for at least a portion of a treatment regimen, which can also include employing a higher initial dose and/or intermittently using higher catalyst levels.

The invention has particular advantage in improving combustion in processes such as the burning of residual fuels, which are notoriously dirty in terms of soot generation. In this case the multi-component catalyst can be employed as a combustion aid to reduce soot formation initially and to aid auto combustion of soot in the ductwork downstream of the combustor. Typical of low catalyst levels for at least a part of a treatment regimen are platinum concentrations of from only 0.0005 to less than 0.15, e.g., less than 0.1, ppm and cerium and/or iron at total concentrations of from only 0.5 to less than 20 ppm. In some embodiments, the treatment regimen will call for the utilizing higher catalyst concentrations at defined intervals or as needed—but not for the whole treatment as has been necessary in the past.

The invention has similar advantage in the case of burning lighter fuels, such as those categorized as fuel oils, such as No. 2 fuel oil, which can result in lesser, but significant production of carbonaceous soot. Typical of low catalyst levels for at least a part of a treatment regimen are platinum concentrations of from only 0.0005 to less than 0.15, e.g., less than 0.1, ppm and cerium and/or iron at total concentrations of from only 0.05 to less than 8 ppm. Again, in some embodiments, the treatment regimen can call for the utilizing higher catalyst concentrations at defined intervals or as needed.

The invention also has significant beneficial use in the area of dual-fuel diesel engines, which although they operate principally on natural gas, utilize a more smoke-producing pilot fuel such as regular diesel fuel. In some cases the catalyst concentrations according to the invention can be the above-noted low catalyst levels for at least a part of a treatment regimen, with platinum concentrations of from only 0.0005 to less than 0.15, e.g., less than 0.1, ppm and cerium and/or iron at total concentrations of from only 0.5 to less than 8 ppm. In some cases, it will be useful to utilize less than 0.05 ppm platinum and a total catalyst level of less than 5 ppm.

These bimetallic and trimetallic platinum combinations provide low temperature soot oxidation with low additive feed rates and cost. The use of the process results in soot oxidation temperatures reduced from 540–600° C. for untreated fuels to 300° C. for fuel treated with about 6 ppm of the bimetallic and trimetallic platinum combinations. Additions of 100 ppm cerium alone reduce the soot oxidation temperature to only about 400° C.

These bimetallic and trimetallic platinum combinations are compatible with standard additive components for distillate and residual fuels such as pour point reducers, antioxidant, corrosion inhibitors and the like.

Among the specific cerium compounds are: cerium III acetylacetonate, cerium III napthenate, and cerium octoate, cerium oleate and other soaps such as stearate, neodecanoate, and other $C_6$ to $C_{24}$ alcanoic acids, and the like. Many of the cerium compounds are trivalent compounds meeting the formula: $Ce(OOCR)_3$ wherein R=hydrocarbon, preferably $C_2$ to $C_{22}$, and including aliphatic, alicyclic, aryl and alkylaryl. The cerium is preferred at concentrations of 1 to 15 ppm cerium w/v of fuel. Preferably, the cerium is supplied as cerium hydroxy oleate propionate complex (40% cerium by weight). Preferred levels are toward the lower end of this range.

Among the specific iron compounds are: ferrocene, ferric and ferrous acetyl-acetonates, iron soaps like octoate and stearate (commercially available as Fe(III) compounds, usually), iron napthenate, iron tallate and other $C_6$ to $C_{24}$ alcanoic acids, iron pentacarbonyl $Fe(CO)_5$ and the like.

Any of the platinum group metal compositions, e.g., 1,5-cyclooctadiene platinum diphenyl (platinum COD), described in U.S. Pat. No. 4,891,050 to Bowers, et al., U.S. Pat. No. 5,034,020 to Epperly, et al., and U.S. Pat. No. 5,266,083 to Peter-Hoblyn, et al., can be employed as the platinum source. Other suitable platinum group metal catalyst compositions include commercially-available or easily-synthesized platinum group metal acetylacetonates, including substituted (e.g., alkyl, aryl, alkyaryl substituted) and unsubstituted acetylacetonates, platinum group metal dibenzylidene acetonates, and fatty acid soaps of tetramine platinum metal complexes, e.g., tetramine platinum oleate. The platinum is preferred at concentrations of 0.05–2.0 ppm platinum w/v (mg per liter) of fuel, e.g., up to about 1.0 ppm. Preferred levels are toward the lower end of this range, e.g., 0.15–0.5 ppm. Platinum COD is the preferred form of platinum for addition to the fuel. The cerium or iron are typically employed at concentrations to provide from 0.5 to 25 ppm of the metal and the platinum from 0.0005 to 2 ppm, with preferred levels of cerium or iron being from 5 to 10 ppm, e.g., 7.5 ppm, and the platinum being employed at a level of from 0.1 to 0.5 ppm, e.g., 0.15 ppm. A preferred ratio of cerium and/or iron to platinum is from 100,000:1 to 10:1, e.g., from 50,000:1 to 500:1. A formulation using 0.0015 ppm platinum with 10 ppm of cerium and 5 ppm of iron is exemplary, with a ratio of cerium plus iron to platinum of about 10,000:1. An alternative exemplary composition will contain 0.0015 ppm platinum with 10 ppm of iron and 5 ppm of cerium.

The combustion according to the invention can be of an emulsion with water, wherein an oil phase is emulsified with water, the water comprising from 1 to 30% water based on the weight of the distillate fuel, residual fuel, aviation kerosene or the like. In the preferred forms, the emulsion will be predominantly of the water-in-oil type and will preferably contain surfactants, lubricity additives and/or corrosion inhibitors in addition to the other components mentioned above. A discussion of suitable emulsion forms and additives is found in U.S. Pat. No. 5,743,922. Combustion can improve combustion efficiency and reduce particulates without the use of oxidation catalysts or particulate filters for enhanced emissions control on diesel engines. Also, better carbon burn out in open flame combustion sources will lead to lower carbon deposits on heat transfer surfaces and lower soot oxidation temperatures on downstream heat recovery devices.

The following examples are presented to further explain and illustrate the invention and are not to be taken as limiting in any regard. Unless otherwise indicated, all parts and percentages are by weight.

EXAMPLE 1

Figure 1B:
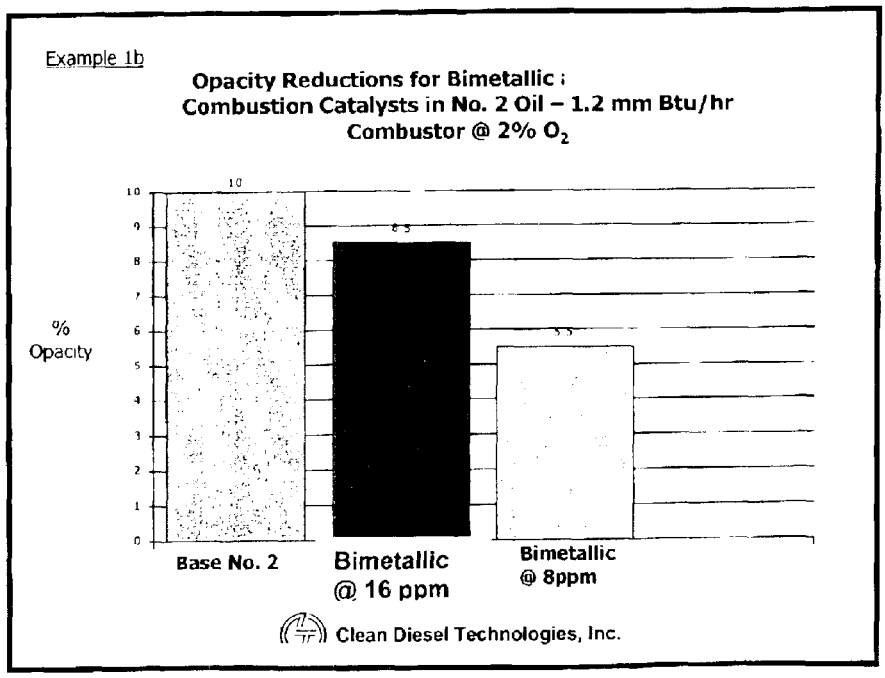
FIG. 1*b* is a graph summarizing the effect of bimetallic and trimetallic FBC's on opacity with No. 2 fuel oil.

This example tests the addition of a bimetallic platinum and cerium fuel borne catalyst (FBC) at 16 ppm and 8 ppm, to No. 2 oil and fired in a 1.2 mm Btu/hr test combustor. As shown in FIGS. 1*a* and 1*b*, both the bimetallic FBC, used at 8 PPM and 16 ppm total catalyst in fuel, reduced particulate mass emissions by 50–70% (FIG. 1*a*). Opacity was also reduced by 15–45% (FIG. 1*b*).

EXAMPLE 2

Figure 2A:
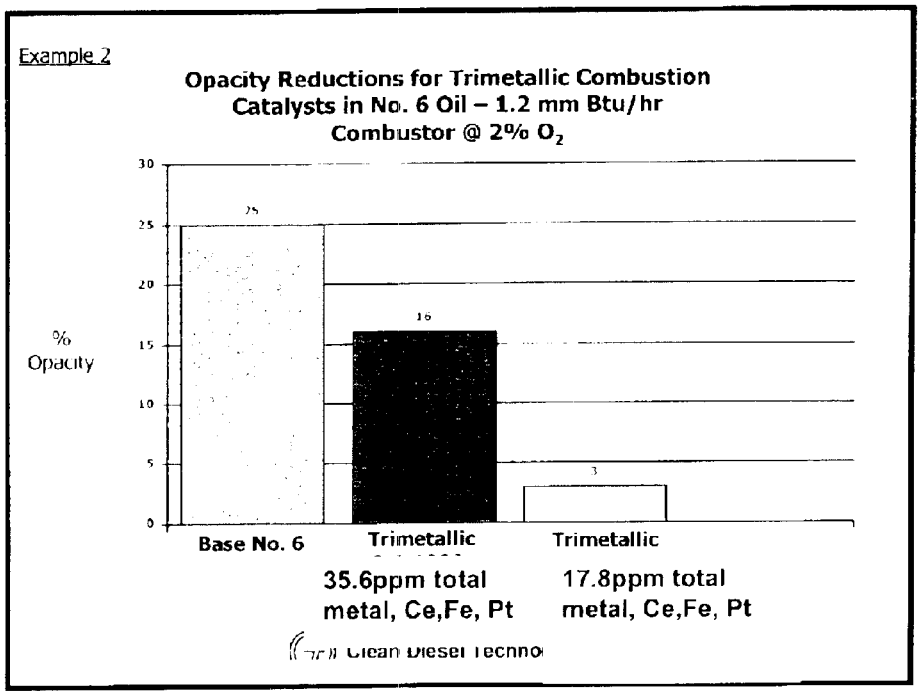
FIG. 2*a* is a graph summarizing the effect of bimetallic and trimetallic FBC's on opacity with No. 6 oil.
Figure 2B:
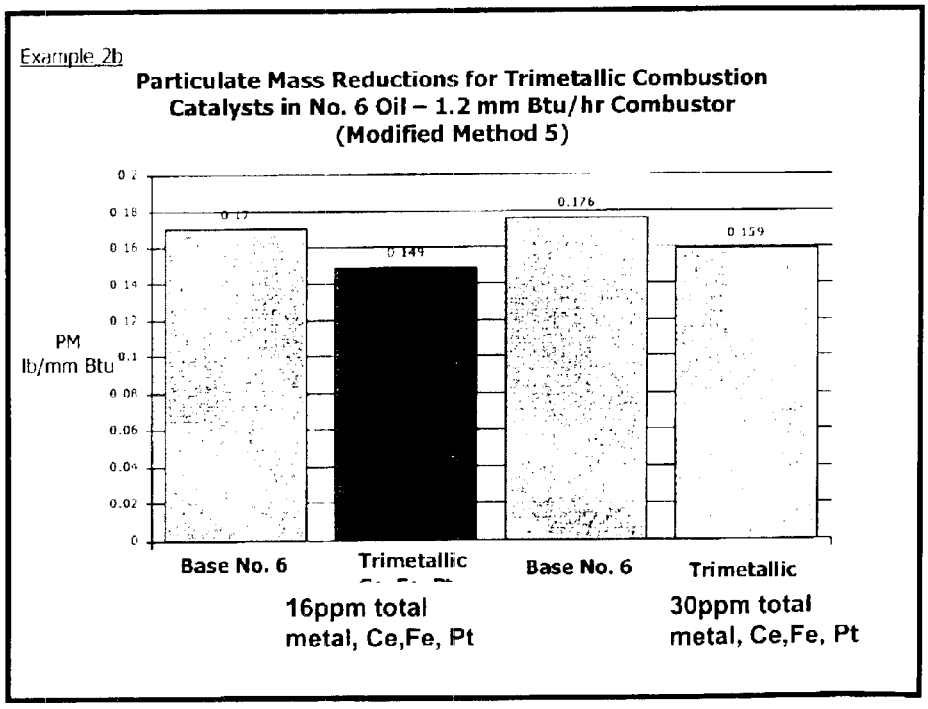
FIG. 2*b* is a graph summarizing the effect of bimetallic and trimetallic FBC's on particulate emissions with No. 6 oil.

This example presents results for two trimetallics containing iron, cerium and platinum catalyst used in No. 6 heavy oil and fired on the same test combustor. The results are summarized in FIG. 2*a* and FIG. 2*b*.

EXAMPLE 3

This example presents results for a platinum and cerium bimetallic FBC used in commercial ultra low sulfur diesel at a total of 4 ppm metal versus normal sulfur fuel and a reference ULSD and tested on a 1998 DDC Series 60 Engine. The results are summarized in the table below:

Emissions Results From a 1998 DDC Series 60 Engine on Various Fuels (Replicate Hot FTP Tests)

| | gr/bhp-hr | | | | lb/hp-hr |
|---|---|---|---|---|---|
| | HC | CO | NOx | PM | BSFC |
| 1998 Standard | 1.3 | 15.5 | 4.0 | 0.10 | NS |
| Base No. 2D | 0.13 | 1.0 | 4.0 | 0.08 | .413 |
| ULSD + Bimetallic FBC @ 0.25 Pt/3.75 Ce | 0.16 | 0.9 | 3.7 | 0.06 | .410 |
| Reference ULSD | 0.35 | 0.9 | 3.9 | 0.08 | .416 |

The above table shows improvements for the FBC treated fuel in HC (54%), $NO_x$ (5%), PM (25%) and fuel economy (1.4%) for a treated ultra low sulfur diesel (ULSD) fuel against a reference ULSD without the additive.

The above description is intended to enable the person skilled in the art to practice the invention. It is not intended to detail all of the possible modifications and variations which will become apparent to the skilled worker upon reading the description. It is intended, however, that all such modifications and variations be included within the scope of the invention which is seen in the above description and otherwise defined by the following claims. The claims are meant to cover the indicated elements and steps in any arrangement or sequence which is effective to meet the objectives intended for the invention, unless the context specifically indicates the contrary.

What is claimed is:

1. A process for improving combustion of residual fuels, which are notoriously dirty in terms of soot generation, to reduce soot formation initially and/or to aid auto combustion of soot in the combustor, on the heat transfer surfaces, or in the ductwork downstream of the combustor, comprising: adding to a residual fuel, a multi catalyst composition comprising platinum at concentrations of from only 0.0005 to less than 0.15 ppm and cerium and/or iron at total concentrations of from only 0.05 to less than 20 ppm, for at least a part of a treatment regimen, wherein the ratio of cerium and/or iron to platinum is within the range of from 50,000:1 to 500:1.

2. A process for improving combustion of distillate fuel oils, which can result in lesser, but significant production of carbonaceous soot, to reduce soot formation initially and/or to aid auto combustion of soot in the combustor, on the heat transfer surfaces, or in the ductwork downstream of the combustor, comprising: adding to a light fuel, a multi catalyst composition comprising platinum at concentrations of from only 0.0005 to less than 0.15 ppm and cerium and/or iron at total concentrations of from only 0.5 to less than 8 ppm, wherein the ratio of cerium and/or iron to platinum is within the range of from 50,000:1 to 500:1.

3. A process for improving combustion of pilot fuel in a dual-fuel diesel engine, which operates principally on natural gas, comprising: adding to a pilot fuel, a multi catalyst composition comprising platinum at concentrations of from only 0.0005 to less than 0.15 ppm and cerium and/or iron at total concentrations of from only 0.5 to less than 8 ppm, wherein the ratio of cerium and/or iron to platinum is within the range of from 50,000:1 to 500:1.

4. A process according to any of claims 1 to 3, wherein the bimetallic and trimetallic platinum combinations provide low temperature soot oxidation with low additive feed rates and cost.

5. A process according to any of claims 1 to 3, wherein the use of the process results in soot oxidation temperatures reduced from 540–600° C. for untreated fuels to 300° C. for fuel treated with about 6 ppm of the bimetallic and trimetallic platinum combinations.

6. A process for combusting a carbonaceous fuel comprising: mixing with fuel or combustion air a multi-component combustion catalyst comprising a platinum composition and cerium and/or iron compositions at levels reduced to as low as 0.0005 ppm for platinum and levels as low as 0.5 ppm for the cerium and iron; and combusting fuel with air in the presence of the catalyst in a regimen of treatment that will utilize effective catalyst levels for a time and under conditions, which will achieve one or more of the noted improvements, wherein the ratio of cerium and/or iron to platinum is within the range of from 50,000:1 to 500:1.

7. A process for combusting a carbonaceous fuel comprising: mixing with fuel or combustion air a multi-component combustion catalyst comprising a platinum composition and cerium and/or iron compositions at levels of from about 0.0005 to 2 ppm for platinum and levels of from about 1 to 25 ppm for the cerium and iron; combusting fuel with air in the presence of the catalyst in a regimen of treatment that will utilize effective catalyst levels for a time and under conditions, which will achieve one or more of the noted improvements; then, for at least a period of time changing the amount of catalyst utilized by mixing with fuel or combustion air a multi-component combustion catalyst comprising a platinum composition and cerium and/or iron compositions at levels reduced to as low as 0.0005 ppm for platinum and levels as low as 0.5 ppm for the cerium and iron; and combusting fuel with air in the presence of the catalyst in a regimen of treatment that will utilize effective catalyst levels for a time and under conditions, which will achieve one or more of the noted improvements, wherein the ratio of cerium and/or iron to platinum is within the range of from 50,000:1 to 500:1.

8. A process for combusting a carbonaceous fuel comprising: for at least a part of a treatment regimen utilizing higher catalyst concentrations, mixing with fuel a multi-component combustion catalyst comprising a platinum composition and cerium and/or iron compositions at levels of 0.0005 to less than 0.15 ppm for platinum and levels of 5 to 10 ppm for the cerium and iron; and combusting the fuel with air in a regimen of treatment that will achieve one or more of the noted improvements, wherein the ratio of cerium and/or iron to platinum is within the range of from 50,000:1 to 500:1.

* * * * *